United States Patent [19]

Yoshikawa

[11] 3,948,202

[45] Apr. 6, 1976

[54] VENTILATION CONTROL APPARATUS FOR AN ENGINE ROOM OF A SHIP

[75] Inventor: Norihiko Yoshikawa, Hamamatsu, Japan

[73] Assignee: Yamaha Hatsudoki Kabushiki Kaisha, Iwata, Japan

[22] Filed: Oct. 29, 1974

[21] Appl. No.: 518,993

[30] Foreign Application Priority Data

Oct. 31, 1973 Japan ..... 48-122619

[52] U.S. Cl. ..... 114/211; 307/9; 340/237 R

[51] Int. Cl.[2] ..... B63J 2/06

[58] Field of Search ..... 114/211; 115/.5 R, .5 E; 307/9; 340/237 R; 98/35 R

[56] References Cited

UNITED STATES PATENTS

| | | | |
|---|---|---|---|
| 3,292,568 | 12/1966 | Morrell | 115/.5 R |
| 3,446,272 | 5/1969 | Gaines, Jr. | 98/33 R |
| 3,489,912 | 1/1970 | Hoffman, Jr. | 114/211 |
| 3,652,868 | 3/1972 | Hunt | 114/211 |
| 3,675,034 | 7/1972 | Abplanalp et al. | 307/9 |

*Primary Examiner*—Trygve M. Blix
*Assistant Examiner*—Sherman D. Basinger
*Attorney, Agent, or Firm*—Flynn & Frishauf

[57] ABSTRACT

A ventilation control apparatus includes a timer and a switch for operating the timer. When the timer is operated an engine room is ventilated and after a preset time, as timed by the timer the engine is automatically started.

8 Claims, 5 Drawing Figures

VENTILATION CONTROL APPARATUS FOR AN ENGINE ROOM OF A SHIP

BACKGROUND OF THE INVENTION

This invention relates to a ventilation control apparatus for an engine room of a small-sized ship such as a motor boat, a small fishing boat etc.

Where any explosive gas such as a hydrocarbon gas is present within the engine room of a small-sized ship, an explosion sometimes takes place by, for example, sparks occurring at the start of a starting motor. It is therefore necessary to preliminarily ventilate an engine room.

A ventilating device of the engine room is arranged independently of an engine starting device as shown in a circuit arrangement (the prior art) of FIG. 1. The starting device comprises an ignition coil IG and a starter motor SM and is energized by the operation of a main switch MSW. The ventilating device or ventilating fan F is operated by a switch SW2 arranged independently of the main switch MSW. In the arrangement shown, therefore, there is a fear that the main switch MSW is operated without preliminarily operating the switch SW2 i.e. an engine is started without preliminarily ventilating the engine room. As a result, an explosion sometimes occurs due to a spark generating at the start of the starting motor. Furthermore, an unnecessary ventilation sometimes continues with the now operating fan indavertently left unattended. In the circuit arrangement of FIG. 1, V denotes a power source; Fu, a fush; SW1, a power source switch; and R1, a relay including a normally open contact RS1.

SUMMARY OF THE INVENTION

A primary object of this invention is to provide a ventilation control apparatus capable of automatically ventilating an engine room of a ship before starting of an engine.

Another object of this invention is to provide a ventilation control apparatus capable of automatically ventilating an engine room of a ship even if an explosive gas prevailing within the engine room exceeds a preset value during the operation of an engine.

Another object of this invention is to provide a ventilation control apparatus capable of automatically stopping a ventilating device, after a necessary ventilation is effected, and then starting an engine.

To attain the above-mentioned objects, a ventilation control apparatus is program controlled timewise using a timer adapted to be switched from a first state to a second state after the lapse of a preset time. Namely, the timer is operated by a main switch and during the preset time a ventilating fan is operated. After the lapse of the preset time, a starting device such as a starter motor etc. is driven. There is also provided means for detecting the presence of a hydrocarbon gas whose amount exceeds a preset value, automatic ventilation being effected through the gas detecting means when the preset value of hydrocarbon gas is detected.

PREFERRED EMBODIMENT OF THE INVENTION

Figure 3:
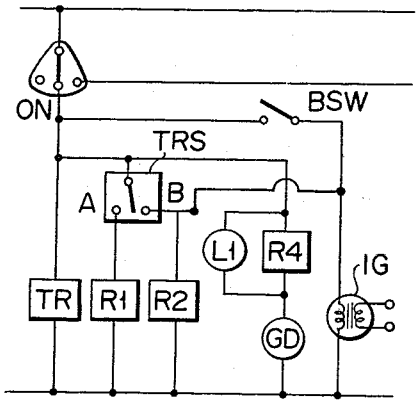
FIG. 3 shows a modification of the device of FIG. 2.

A ventilation control apparatus according to the present invention will be explained by reference to FIG. 2.

To the positive polarity terminal of a DC power source V a first bus line I1 is connected through a fuse Fu and a power source switch SW1. A movable contact of a main switch MSW is connected to the bus line I1. A second bus line I2 is connected through a fuse Fu and a power source switch SW1 to the negative polarity terminal of the DC power source V. A stationary ON contact of the main switch MSW is connected through a timer TR to the second bus line. The switch SW1 may be operated in interlock with a known suitable connecting mechanism. The main switch MSW further includes a stationary OFF contact and a stationary ST (start) contact. The movable contact of the main switch MSW takes three positions i.e. in the first position it is contacted with the OFF contact; in the second position it is contacted with the ON contact; and in the third position it is associated with both the ON and ST contacts. The main switch MSW may be similar in construction to an OFF-start-ignition switch of an automobile.

In parallel with the timer TR is connected a series circuit comprising a timer switch TRS and a first relay R1. The movable contact of the timer switch TRS is connected to the ON contact of the main switch MSW and a first stationary contact A of the switch TRS is connected to the bus line I2 through the relay R1. Between a second stationary contact B of the switch TRS and the second bus line I2 are parallelly arranged a second relay R2, an ignition coil IG and a series circuit comprised of a fourth relay R4 and a detector GD for detecting the concentration of a combustible gas such as a hydrocarbon gas with one another. The fourth relay R4 is connected in parallel with a display lamp L1 for displaying the operation of the detector GD. A bypass switch BSW for bypassing the timer switch TRS is connected between the ON contact of the main switch MSW and the ignition coil IG.

A normally open contact RS2 of the second relay R2 and a third relay R3 is serially connected between the ST contact of the main switch MSW and the bus line I2. Three series circuits are connected between the first and second bus lines I1 and I2. The first series circuit comprises a normally open contact RS3 of the third relay R3 and a starter motor SM. The second series circuit includes a normally open contact RS1 of the first relay R1 and a switch F for operating a ventilating fan and the third series circuit includes a normally open contact RS4 of the fourth relay R4 and a display lamp L2 for indicating the operation of the fan. A junction between the normally open switch RS1 and the switch F is connected to a junction between the normally open switch RS4 and the display lamp L2.

When the timer TR is energized, it causes the movable contact of the switch TRS to be connected to the contact A thereof during its preset time. After the lapse of a preset time, for example, three minutes it causes the movable contact of the switch TRS to be connected to the contact B thereof.

The operation of the ventilation control apparatus illustrated in FIG. 2 will now be explained below.

The power source switches SW1 are closed and the movable contact of the main switch MSW is moved into contact with the On contact. As a result, the timer TR is operated to cause the movable contact of the switch TRS to be moved into contact with the contact A to permit the first relay R1 to be energized. With the energization of the relay R1 the normally open contact RS1 is closed to cause the ventilation fan F to be operated. After the lapse of the above-mentioned preset time of the timer TR the movable contact of the switch TRS is moved from the contact A to the contact B. As a result, the ventilating fan F is stopped and the ignition coil IG is energized. When the movable contact of the main switch MSW is operatively associated with the ST switch (i.e., it is moved to the start position), the relay R3 is energized through the already closed contact RS2 of the relay R2 and the normally open contact RS3 of the relay R3 is closed. In consequence, the starter motor SM is operated through contact RS3 and the engine is started. When, after the starting of the engine, a hydrocarbon gas prevalent within an engine room is thickened and exceeds a preset value for some reason, the gas detector GD is operated to cause the relay R4 to be electrically connected to the second bus line I2. As a result, the relay R4 is energized to cause is normally open contact RS4 to be closed to permit the ventilating fan F to be again operated. By the operation of the ventilating fan F, the engine room is ventilated. The ventilating operation is continued until the concentration of the hydrocarbon gas prevailing within the engine room is decreased to below a preset value to cause the relay R4 to be de-energized through the gas detector GD. During the operation of the ventilating fan F the display lamp L2 is lighted. On the other hand, the display lamp L1 is lighted through the gas detector GD during the time period in which the concentration of the hydrocarbon gas exceeds the preset value.

Where an engine of a ship is desired to be urgently started for some reason, the by-pass switch BSW need only be closed and the engine may be started irrespective of any operative position of the timer switch TRS.

Figure 2:
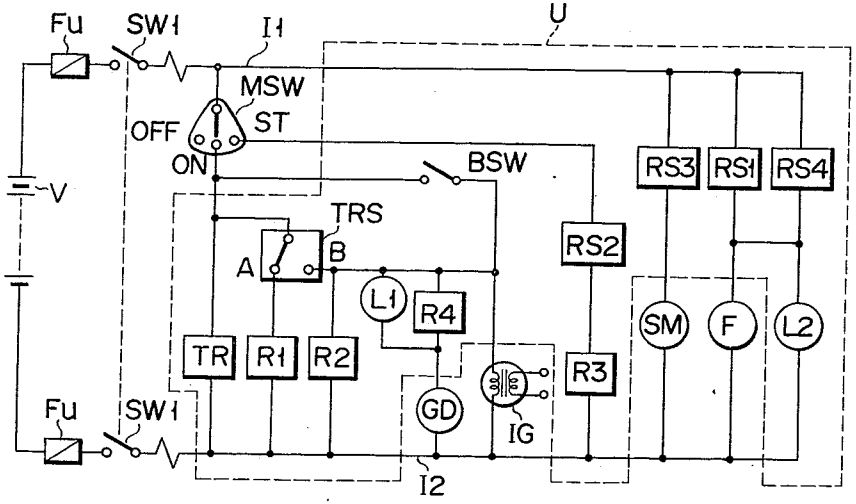
FIG. 2 shows a circuit arrangement of a ventilation control apparatus according to the preset invention.

If the ventilation control apparatus is made compact by assembling that portion of the ventilation control apparatus as enclosed by dotted lines shown by U in FIG. 2 into a separate unit-type switch mechanism, it can be easily incorporated into a small-sized ship.

In the above-mentioned embodiment the gas detector GD is designed to be operated under the condition that the movable contact of the timer switch TRS is contacted with the contact B and that the concentration of the hydrocarbon gas exceeds a preset value. However, the gas detector GD can be arranged in parallel wih the timer switch TRS as, for example, shown in FIG. 3 so that it can be operated independently of the timer switch.

As the timer and switch used in the above-mentioned embodiment, a conventional mechanical or electrical timer and switch may be employed. Though in the above-mentioned embodiment a single gas detector is employed, a plurality of gas detectors can be incorporated into the ventilation control apparatus. If, in this case, the gas detectors are connected in parallel with each other and arranged at predetermined locations within the engine room at the ship, a more accurate and more reliable ventilation control apparatus can be obtained.

Figure 5:
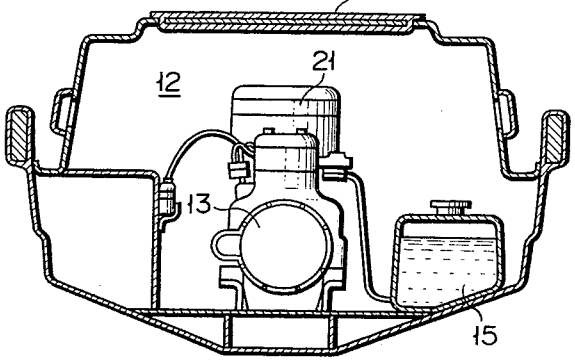
FIG. 5 is a cross-sectional view taken along line 5—5 of FIG. 4.
Figure 1:
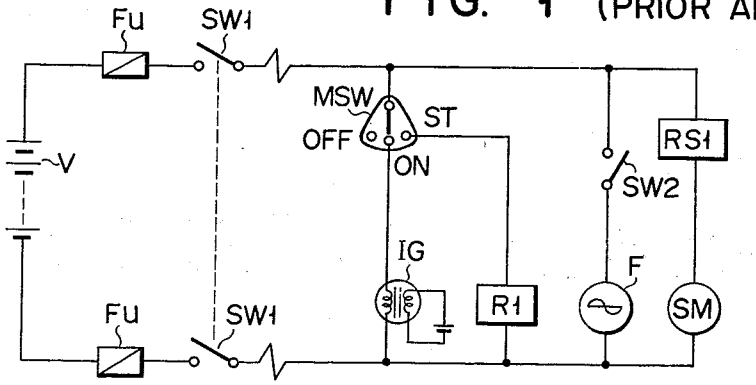
FIG. 1 (PRIOR ART)
FIG. 1 shows a conventional circuit arrangement of a ventilation control apparatus for an engine room of a ship.
Figure 4:
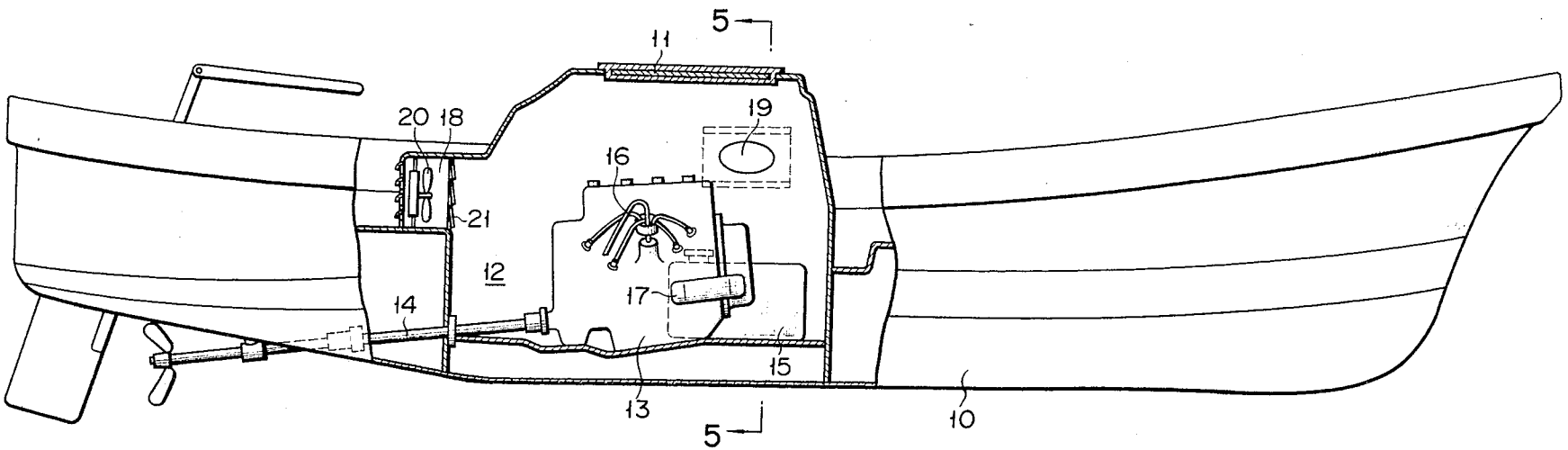
FIG. 4 is a side view, partly broken away, showing a ship into which the ventilation control device of FIG. 2 is incorporated.

There will now be explained, by reference to FIGS. 4 and 5 cojointly, the case where the above-mentioned ventilation control apparatus is incorporated into a small-sized ship.

An engine room 12 having a hatch cover 11 at its upper end is formed within a hull 10. A gasoline engine 13 is mounted on the bottom of the engine room 12 and a drive shaft 14 of the engine 13 extends downwardly of the hull and has a screw at its free end. In the neighborhood of the engine 13 is disposed a fuel tank 15 for supplying gasoline to the engine 13. The engine 13 is of a conventional type and includes a conventional distributor 16 and starter motor 17. A ventilation passage or air passage 18 is provided in the upper portion of the rear end of the engine room 12 to communicate the engine room 12 to an atmosphere and an exhaust port 19 is disposed near the upper portion of the side wall of the engine room 12. In the neighborhood of the rear end of the air passage 18 is disposed an explosion-proof air supply device or fan 20 which is connected to the fan switch F. In front of the fan 20 is provided a shutter 21 adapted to be opened by an outer air introduced by the operation of the fan 20.

With the ship so arranged, the fan is driven, by engaging the movable contact of the main switch MSW with the fixed ON contact, to cause an outer air to be introduced through the air supply passage 18 into the engine room 12. The air within the engine room 12 is exhausted through the exhaust port 19. After such a ventilation is effected for a predetermined period of time, the engine is started, and normally driven, by engaging the moving contact of the main switch MSW with the ST contact.

The above-mentioned ventilation control apparatus is not restricted in its application to such a ship. For example, it may be used in a Diesel engine ship.

According to this invention the ventilation fan and starting device such as the starter motor etc. are program controlled time wise using the timer adapted to be switched after the lapse of the preset time. Therefore, ventilation is always effected before the starting of the engine, thus affording an enhanced operational stability to a small-sized ship. Since such program control is easily and positively effected, even the less experienced operator can avoid any possible error involved in operating the ventilating fan.

A combustible gas explosion can also be prevented by detecting only the concentration of a gas prevailing within the ship and effecting ventilation. In this case, however, it is necessary to provide a relatively high performance - in other words, expensive - gas detector. The concentration of a gas within an engine room locally differs due to the construction of the engine room and the type of selfventilation. In an attempt to effect a more complete gas detection a plurality of gas detectors will be necessary. According to this invention no such consideration will be needed. Furthermore, even during engine operation automatic ventilation can be effected by detecting the concentration of hydrocarbon impurities. As a result, the ventilation capability is enhanced.

What is claimed is:

1. A ventilation control apparatus for an engine room of a ship which contains a gasoline engine of a spark ignition type, comprising:

a source of electrical power (V, I1, I2);

a ventilating device opened at one end to the engine room and at the other end to the atmosphere for ventilating the engine room;

a device (SM) coupled to the engine for starting the engine;

a main switch (MSW) coupled to the power source for starting the engine;

a timer (TR) coupled to the main switch (MSW) and to the timer switch (TRS) and responsive to the operation of the main switch (MSW) and to cause the timer switch (TRS) to be, for a predetermined period of time, in a first state (A) where the engine starting device (SM) is not energized and the ventilating device is energized and operated, and after the lapse of the predetermined period of time to cause the timer switch (TRS) to be in a second state (B) where the engine starting device (SM) is energized through the main switch (MSW) when the main switch (MSW) is operated to an engine starting position; and a gas detector (GD) coupled to said ventilating device and to the power source so as to be operable at all times that the power source is energized, and in communication with the engine room for detecting the amount of combustible gas in the engine room, said gas detector being responsive to the amount of combustible gas in the engine room reaching a predetermined level for energizing and operating only the ventilating device independently of the state of the timer (TR), without affecting the operation of the engine.

2. A ventilation control apparatus according to claim 1, in which said timer (TR) stops the energization of said ventilating device after the lapse of the predetermined length of time.

3. A ventilation control apparatus according to claim 2 in which said ventilating device is de-energized when said timer switch (TRS) is in the second state (B).

4. A ventilation control apparatus according to claim 1, in which said ventilating device introduces outer atmospheric air into the engine room.

5. A ventilation control apparatus according to claim 1, in which said ventilating device comprises an air passage communicating the engine room to the atmosphere, an electrically driven fan (F) operatively coupled to said timer switch (TRS) and disposed in the air passage near the atmosphere, and a shutter device disposed in the air passage near the engine room to shut the air passage during the stopping of the fan.

6. A ventilation control apparatus according to claim 1 in which said main switch (MSW) has an OFF position, ON position and a ST (start) position, said timer switch being operated for said predetermined period of time when said main switch is operated to the ON position.

7. A ventilation control apparatus to claim 1 in which a by-pass means (BSW) is coupled to said main witch (MSW) to enable the engine to be started irrespective of the state of the timer switch (TR).

8. A ventilation control apparatus to claim 7 in which said engine starting device comprises a starting motor and an ignition coil for the engine, the by-pass means coupling th ignition coil directly to the main switch.

* * * * *